US007654304B2

(12) United States Patent
Wayman et al.

(10) Patent No.: US 7,654,304 B2
(45) Date of Patent: Feb. 2, 2010

(54) CLAMSHELL CHASSIS ASSEMBLY

(75) Inventors: Michael J. Wayman, Waconia, MN (US); Stephen J. Qualy, Shakopee, MN (US); Gregory Martell, Chanhassen, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 441 days.

(21) Appl. No.: 11/692,014

(22) Filed: Mar. 27, 2007

(65) Prior Publication Data

US 2008/0241571 A1 Oct. 2, 2008

(51) Int. Cl.
*B22D 33/04* (2006.01)
*B22D 17/00* (2006.01)

(52) U.S. Cl. ..... 164/76.1; 164/137; 164/339; 164/342

(58) Field of Classification Search ..... 164/76.1, 164/137, 339, 342
See application file for complete search history.

(56) References Cited

U.S. PATENT DOCUMENTS 3,778,529 A 12/1973 Miller
5,249,099 A 9/1993 Sridharan et al.
5,292,189 A 3/1994 Lau et al.
5,380,083 A 1/1995 Jones et al.
5,388,903 A 2/1995 Jones et al.
5,407,263 A 4/1995 Jones et al.
6,238,027 B1 * 5/2001 Kohler et al. ..... 312/265.1
7,518,863 B2 * 4/2009 Wayman et al. ..... 361/690
2004/0085770 A1 5/2004 Tyler et al.
2007/0247809 A1 10/2007 McClure

FOREIGN PATENT DOCUMENTS

GB 2153152 8/1985
WO 2008010987 1/2008

OTHER PUBLICATIONS

P.I. Castings Ltd., "Advertisement: Investment Casting", "Aircraft Engineering", May 1, 1990, p. 13, vol. 62, No. 5, Publisher: Bunhill Publications Ltd., Published in: London, GB.

* cited by examiner

*Primary Examiner*—Kevin P Kerns
(74) *Attorney, Agent, or Firm*—Fogg & Powers LLC

(57) ABSTRACT

A method of manufacturing a chassis is provided. The method comprises casting a first segment having a plurality of connected walls such that a window is cast in each of two of the plurality of connected walls in the first segment; casting a second segment having a plurality of connected walls such that a window is cast in each of two of the plurality of connected walls in the second segment; and coupling the first and second segments together to form the chassis having a window in four walls.

14 Claims, 6 Drawing Sheets

CLAMSHELL CHASSIS ASSEMBLY

BACKGROUND

A chassis assembly is used in various environments. For example, a chassis can be used as an indoor enclosure or an outdoor enclosure on a utility pole, on the outside of building, in a vault underground, etc. In order to protect circuitry inside the chassis, the chassis needs to be sealed against elements in the environment, such as dust, corrosive airborne contaminates, or water. Furthermore, some chassis support modules often are coupled to the chassis. These chassis, therefore, use openings or windows to allow access to the interior of the chassis. These windows or openings also need to be sealed against elements in the environment.

Although current casting and machining technology enables the construction of chassis which meet the above criteria, it is desirable to reduce the costs and complexity of the chassis. For example, machining a chassis is significantly more expensive than casting. However, current casting techniques have other limitations, such as the ability to only cast a window in one wall of the chassis.

SUMMARY

In one embodiment, a method of manufacturing a chassis is provided. The method comprises casting a first segment having a plurality of connected walls such that a window is cast in each of two of the plurality of connected walls in the first segment; casting a second segment having a plurality of connected walls such that a window is cast in each of two of the plurality of connected walls in the second segment; and coupling the first and second segments together to form the chassis having a window in four walls.

In another embodiment, a method of casting a segment of a chassis having a plurality of walls with a window in each of two of the plurality of walls is provided. The method comprises creating a mold including a cope and a drag such that the mold cavity formed when joining the cope and the drag defines a plurality of connected walls with a window in each of two of the plurality of connected walls; injecting molten material into the mold cavity; and separating the cope and the drag after the molten material has cooled to release the casted segment.

In yet another embodiment, a casting mold is provided. The casting mold comprises a cope; and a drag; wherein the cope and the drag are configured such that, when joined together, the cope and the drag form a molding cavity which defines a plurality of connected walls with a window in each of two of the plurality of connected walls; wherein the cope and the drag are further configured such that the parting plane of the casting mold is oriented at approximately a 45 degree angle from each of the two defined walls with a window.

In another embodiment, a chassis is provided. The chassis comprises a first casted segment comprising two side walls, a top wall, and a bottom wall which together define a continuous edge oriented at a 45 degree angle from each of the two side walls, each of the two side walls having a window; and a second casted segment comprising two side walls, a top wall, and a bottom wall which together define a continuous edge oriented at a 45 degree angle from each of the two side walls, each of the two side walls having a window; wherein the first and second casted segments are coupled together at the respective continuous edges to form the chassis.

DRAWINGS

DETAILED DESCRIPTION

Figure 1A:
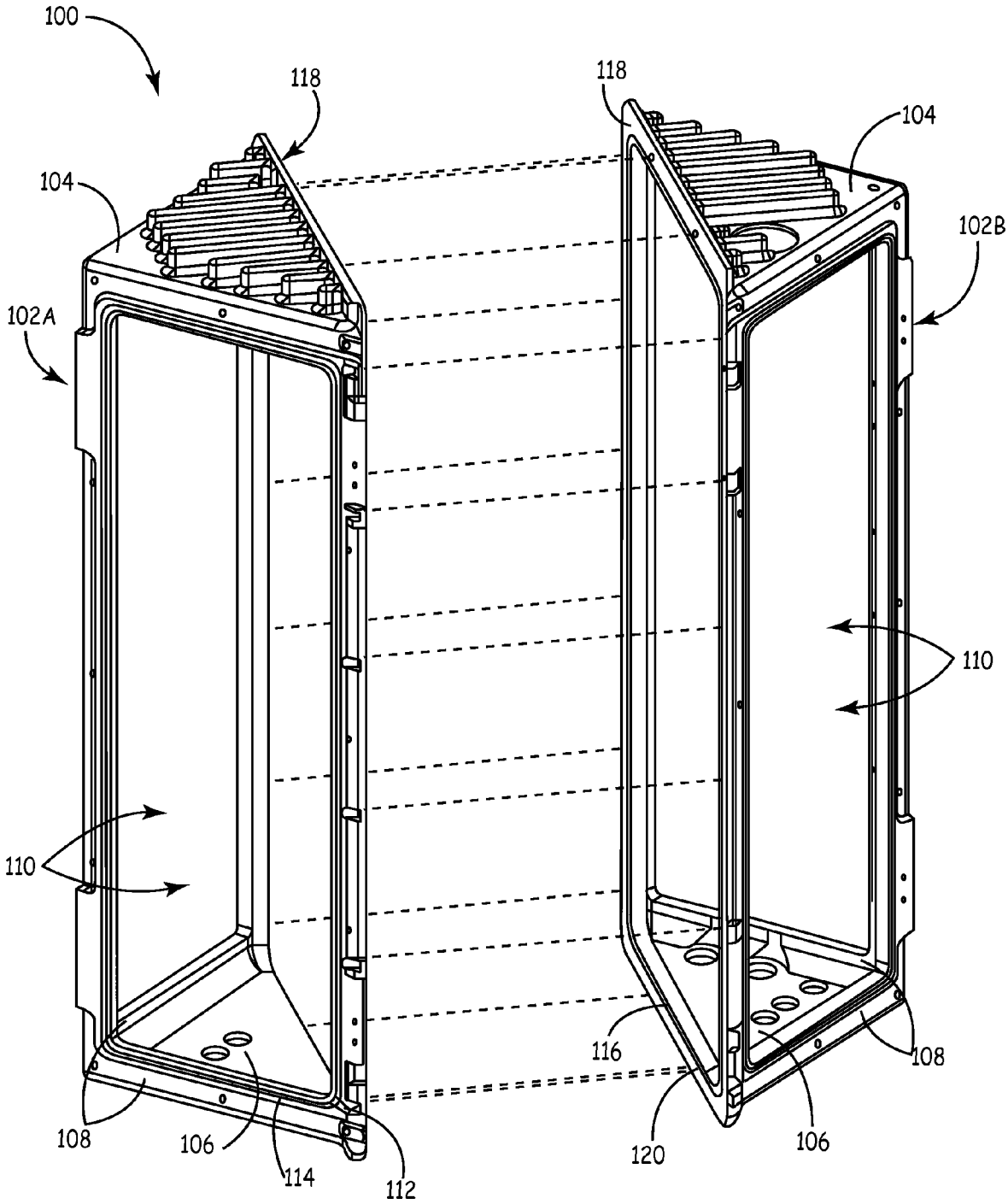
FIG. 1A is an exploded perspective view of a clamshell chassis according to one embodiment of the present invention.

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical and/or mechanical changes may be made without departing from the scope of the present invention. It should be understood that the exemplary methods illustrated may include additional or fewer steps or may be performed in the context of a larger processing scheme. Furthermore, the methods presented in the drawing figures are not to be construed as limiting the order in which the individual steps may be performed. The following detailed description is, therefore, not to be taken in a limiting sense.

Embodiments of the present invention reduce the manufacturing costs of producing a chassis when compared to machining. In addition, embodiments of the present invention reduce the complexity of the chassis assembly. In particular, embodiments of the present invention enable a chassis to be cast in two segments. Each segment has two side walls with a window in each side wall. Current casting techniques lack this ability to cast a window in two sides of the same segment without complicated and expensive sliding cores. Therefore, a chassis according to embodiments of the present invention needs only one seal to couple the two segments and each window has a continuous seal around the perimeter of the window. Using one continuous seal around each window and to couple the two segments simplifies the assembly process and improves the ability of the chassis seal to block elements in the environment.

FIG. 1A is an exploded perspective view of a clamshell chassis 100 according to one embodiment of the present invention. Chassis 100 comprises two cast segments 102A and 102B. Each of cast segments 102A and 102B has a top wall 104, a bottom wall 106, and two side walls 108. Each cast segment is cast using one of sand casting, die casting, or any other similar casting techniques. In addition, the two side walls 108 in each of cast segments 102A and 102B have a window 110. A window is an opening which allows access to the interior of chassis 100. In this embodiment, the window 110 in each of the side walls 108 occupies the majority of the surface area of each side wall 108. The two windows 110 in cast segments 102A and 102B are cast in side walls 108 rather than being machined out. In particular, the two windows 110 in each of cast segments 102A and 102B are cast simultaneously with side walls 108, top wall 104, and bottom wall 106. Exemplary molten materials used in casting segments 102A and 102B include, but are not limited to, iron, steel, bronze, brass, aluminum, and plastic.

Around the perimeter of each window 110 is a seal 112. A groove 114 for seal 112 is machined out around the perimeter of each window 110 after the windows 110 are cast. Similarly, a seal 116 is placed in a groove 120 in edge 118 which extends along top wall 104, side walls 108 and bottom wall 106 in segment 102B. A similar groove is not located in edge 118 of segment 102A, in this embodiment. Seals 112 and seal 116 are o-ring seals in this embodiment. However, it is to be understood that other types of seals can be used in other embodiments.

Figure 1B:
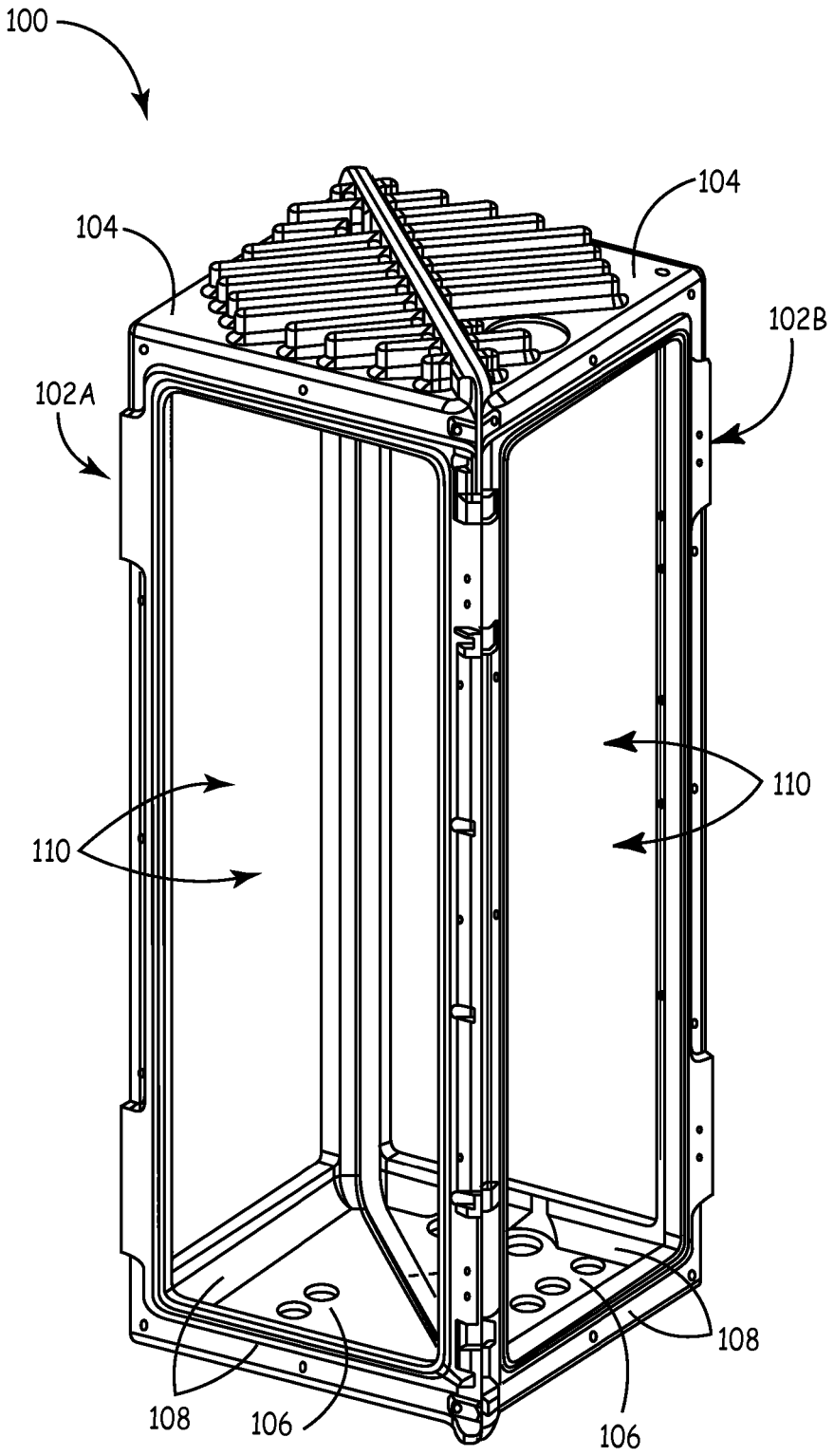
FIG. 1B is a perspective view of a clamshell chassis according to one embodiment of the present invention.

Segments 102A and 102B are coupled together at their respective edges 118 as shown in FIG. 1B. Edges 118 are formed in segments 102A and 102B during the casting process at an approximately 45° angle from each of side walls 108. Casting edges 118 at an approximately 45° angle provides various advantages for manufacturing chassis 100. In particular, a continuous edge is formed for coupling segments 102A and 102B. Therefore, one continuous seal 116 is able to seal segments 102A and 102B when joined together. However, in some typical chassis, each side wall is cast separately. Casting the side walls separately creates a seam at each point of connection between the side walls requiring 4 separate seals. In embodiments of the present invention, however, only one continuous seal is needed to join segments 102A and 102B. In addition, in some embodiments, where the bond between the two castings can be made permanent, a metal bonding agent is used along with two alignment pins to bond segments 102A and 102B together, reducing the risk of leakage and the cost of fasteners and seals.

In other typical chassis, windows are formed by coupling two or more pieces or segments together with a portion of the window formed in each segment. However, this creates additional seams where the segments are coupled which need to be sealed. Casting edge 118 at an angle from side walls 108, as shown in FIGS. 1A and 1B, eliminates the additional seams from windows 110 since windows 110 are not divided into two or more pieces in any of side walls 108. Therefore, a single continuous seal 112 is able to seal each window 110 to a module attached to chassis 100.

In addition, through use of seals 112 and 116, chassis 100 is submersible in water. In particular, in this embodiment, chassis 100 is designed to have an ingress protection (IP) rating of IP67 when completely sealed. The IP67 rating indicates that chassis 100 is dust tight and protects against the effects of immersing chasing 100 in water up to 1 meter.

Furthermore, casting edge 118 at an angle from side walls 108 enables windows 110 to be cast in each side wall 108 simultaneously. In a typical cast chassis, a window can only be cast in one side wall. This limitation is due to the fact that the mold used to cast the side walls only pulls apart in one direction. Therefore, the plane of a window to be cast typically lies perpendicular to the direction in which the mold is pulled apart. However, casting two side walls in each of segments 102A and 102B with edge 118 at an angle from each side wall enable casting a window in each side wall 108 as described in more detail below.

Casting the windows 110 reduces the cost associated with manufacturing chassis 100 versus machining out windows 110. Additionally, segments 102A and 102B are identical when cast (that is, each is cast using the same mold). This further reduces cost by enabling the use of one mold rather than two separate molds. Some minor features, such as grooves 114 and 120, are then machined out of segments 102A and 102B after the segments are cast. Other features that are machines include tap holes and clearance holes. For example, since segments 102A and 102B are casted using the same mold, one segment is machined with tap holes and the other with corresponding clearance holes. Hence, the cost of manufacturing chassis 100 is reduced when compared to machining chassis 100 or using typical casting techniques. In addition, the number of necessary seals in chassis 100 is reduced when compared to chassis produced with typical casting techniques.

Figure 2:
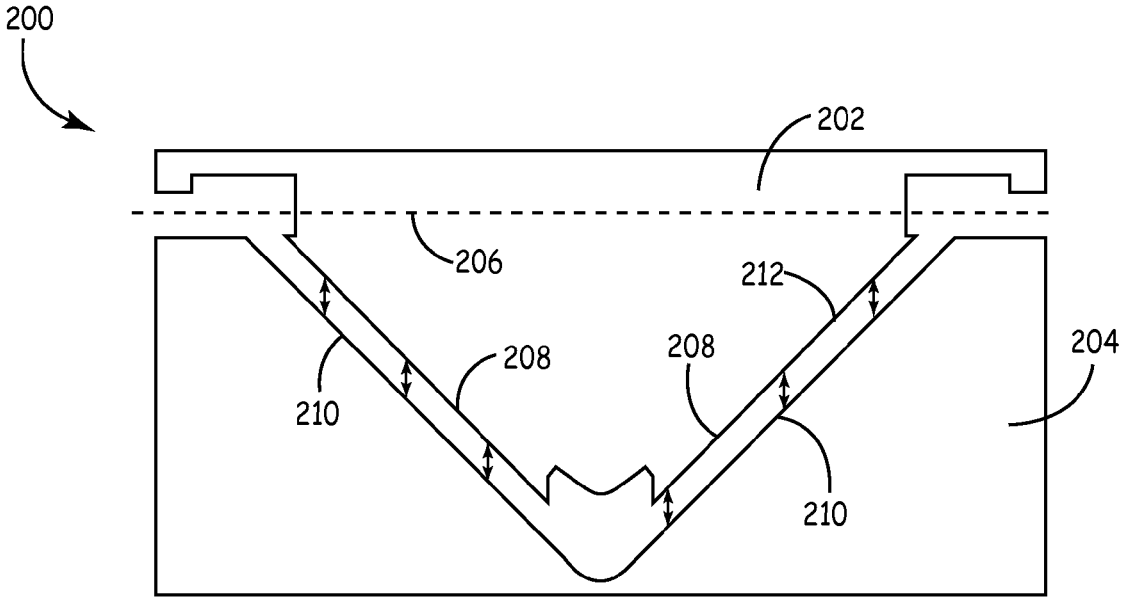
FIG. 2 is a cross-section view of a casting mold according to one embodiment of the present invention.

FIG. 2 is a cross-section view of a casting mold 200 according to one embodiment of the present invention. Casting mold 200 is used to cast segments of a chassis such as segments 102A and 102B shown in FIG. 1A. In this example, casting mold 200 is a sand casting mold. However, it is to be understood that casting mold 200 can be implemented as other types of casting molds, such as a die cast mold.

Casting mold 200 includes cope 202 and drag 204. Cope 202 and drag 204 are configured to form a molding cavity when joined which defines a plurality of connected walls with a window in each of two of the plurality of connected walls. In particular, in the cross-section view in FIG. 2, a window is defined where surface 208 of cope 202 contacts surface 210 of drag 204. The molding cavity which defines the walls is formed where cope 202 and drag 204 do not come into contact.

In addition, cope 202 and drag 204 are configured such that the parting plane 206 is oriented at an approximately 45° angle from surfaces 208 and 210. Cope 202 and drag 204 are separated in a direction perpendicular to parting plane 206 as indicated by arrows 212. Therefore, by orienting parting plane 206 at approximately 45° from surfaces 208 and 210, a window is cast in each of two walls defined by surfaces 208 and 210. Cope 202 defines the inner portion of the plurality of walls while drag 204 is configured to define the outer portion of the plurality of walls.

Figure 3:
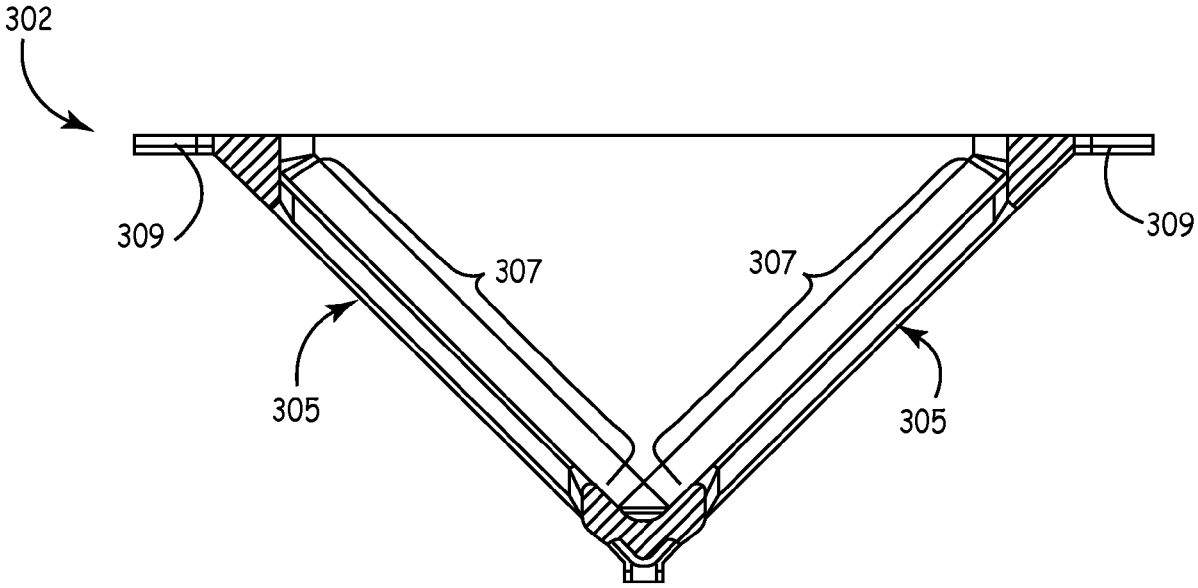
FIG. 3 is a cross-section view of a cast chassis segment according to one embodiment of the present invention.

A cross-section view of a chassis segment 302 cast using casting mold 200 is shown in FIG. 3. As shown in FIG. 3, a window 305 is located in each of two side walls 307. Also shown in FIG. 3 are risers 309. Risers 309 are reservoirs used to prevent air cavities from forming in the chassis segment 302 due to shrinkage of the molten material as it cools. Risers 309 prevent air cavities by providing molten material as the chassis segment 302 cools so that any air cavities form in risers 309 and not in the chassis segment 302. Once chassis segment 302 has cooled, risers 309 are removed.

Figure 4:
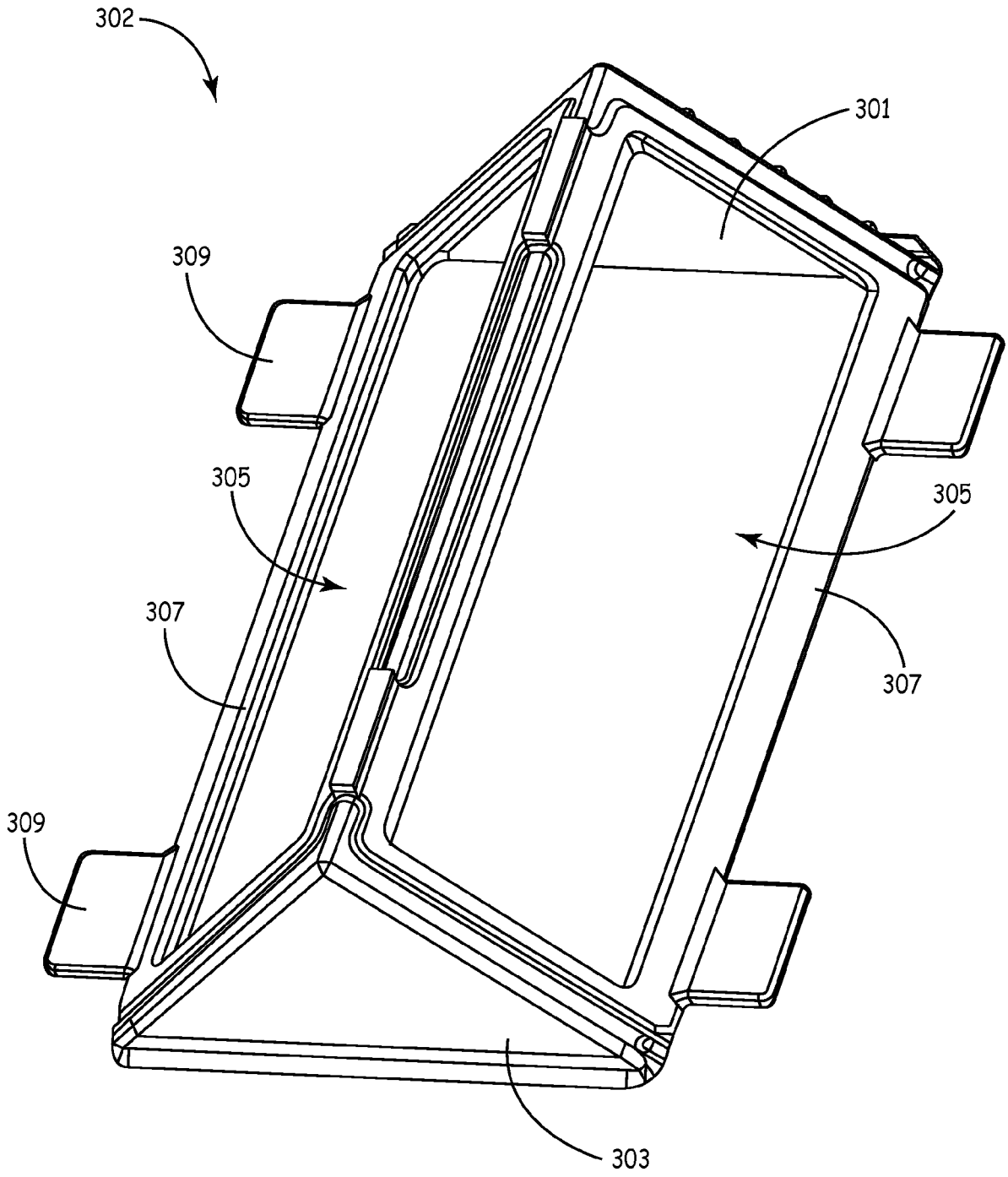
FIG. 4 is a perspective view of a cast chassis segment according to one embodiment of the present invention.

FIG. 4 is a perspective view of the chassis segment 302 cast using casting mold 200. As shown in FIG. 4, a window 305 is cast in each side wall 307. Also visible are top wall 301, bottom wall 303, and risers 309. As stated above, risers 309 are removed once chassis segment 302 has cooled. Notably, it is to be understood that a tool having the same shape as chassis segment 302 is used to configure cope 202 and drag 204 of casting mold 200. Also, it is to be understood that although not shown, casting mold 200 also includes other features, such as a pouring cup, for injecting a molten material into casting mold 200 as known to one of skill in the art.

Figure 5:
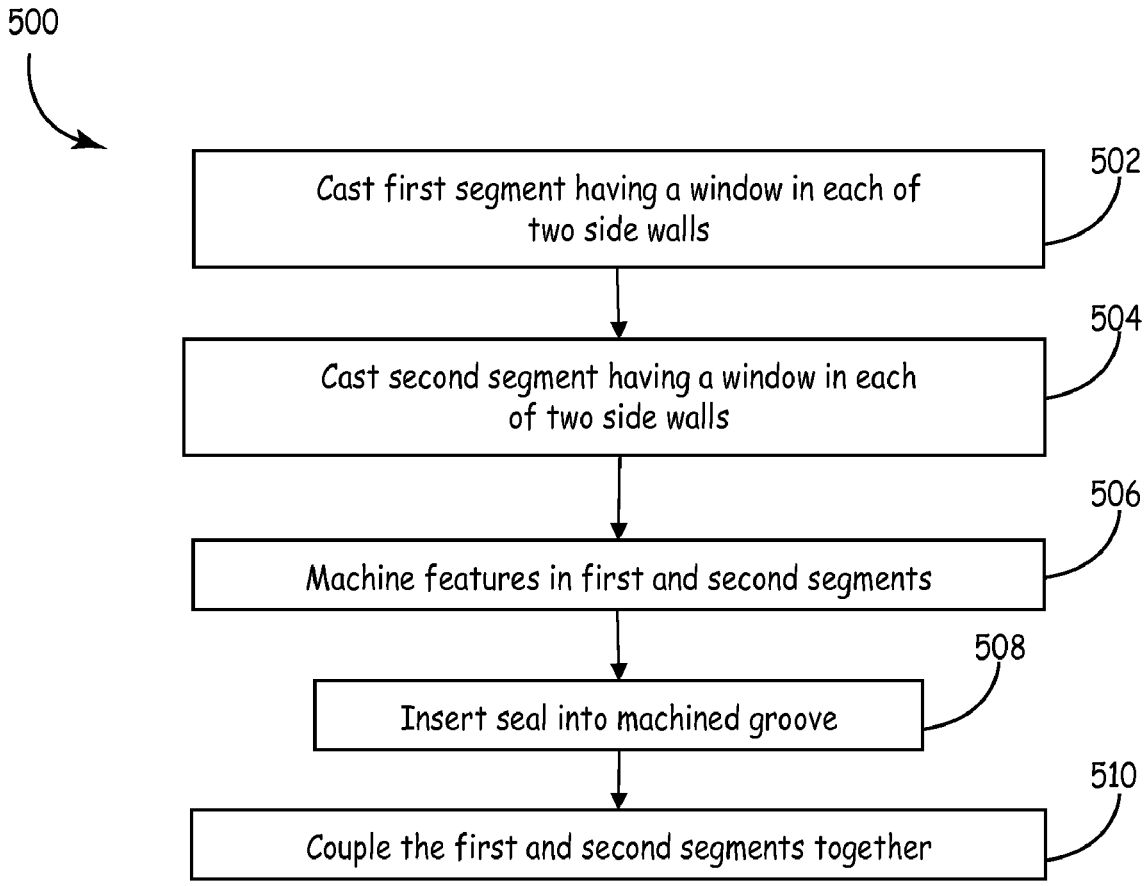
FIG. 5 is a flow chart showing a method of manufacturing a chassis according to one embodiment of the present invention.

FIG. 5 is a flow chart showing a method 500 of manufacturing a chassis according to one embodiment of the present invention. Method 500 is used to cast chassis segments such as segments 102A and 102B shown above in FIG. 1. At 502, a first segment is cast. The first segment is cast with a plurality of walls and a window in two of the plurality of walls. In particular, the first segment has a top wall, a bottom wall, and two side walls each side wall having a window. At 504, a second segment is cast. The second segment is also cast with a plurality of walls and a window in two of the plurality of walls. In particular, the second segment has a top wall, a bottom wall, and two side walls each side wall having a window.

The first and second segments are sand cast in this embodiment. However, other casting techniques, such as die casting, can be used in other embodiments. In addition, the first and second segments are each cast using the same mold in this embodiment. With regards to sand casting, using the same mold includes using the same tool or pattern to configure the cope and drag of the casting mold. Hence, the first and second segments are substantially identical when cast. Details of casting the first and second segments are discussed below with regards to FIG. 6.

At 506, features are machined in the first and second segments. In this embodiment, a seal groove (e.g. groove 120) is machined in an edge (e.g. edge 118 in FIG. 1) of the first segment which extends along the plurality of walls in the first segment. A seal groove is also machined around the perimeter of each window (e.g. groove 114). Additionally, other features are machined in one or both of the first and second segments. For example, the first segment is machined with tapped holes and the second segment is machined with clearance holes. At 508, a continuous seal (e.g. seal 116) is inserted into the seal groove in the edge of the first segment as well as in the groove around the perimeter of each window. In this embodiment, an o-ring seal is inserted into the grooves. However, it is to be understood that other seals or gaskets can be used in other embodiments.

At 510, the first segment is coupled to the second segment. The segments are coupled using screws which fit the tap and clearance holes machined in the first and second segments at 506. In particular, the first segment and second segments are coupled at the continuous edge which extends along the plurality of walls of the first and second segments respectively. The continuous edge in each of the first and second segments is cast at 502 such that it is oriented at a 45 degree angle from each of two side walls as shown in segment 102A in FIG. 1. Hence, a chassis is formed which has a window in four side walls with only one continuous seam coupling the first and second segments together.

Figure 6:
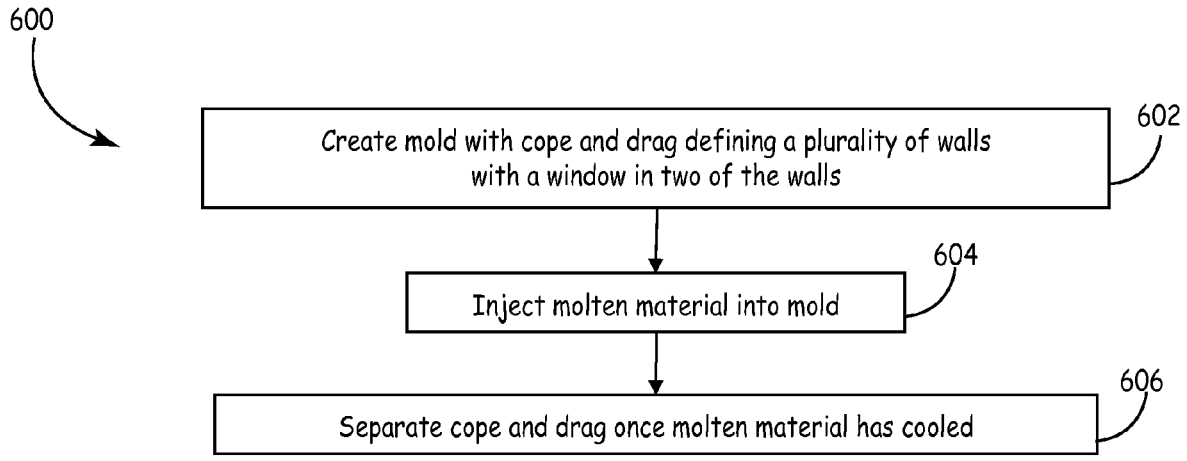
FIG. 6 is a flow chart showing a method of casting a segment of a chassis according to one embodiment of the present invention.

FIG. 6 is a flow chart showing a method 600 of casting a segment of a chassis according to one embodiment of the present invention. At 602, a mold comprising a cope and a drag is created. The mold is created such that the mold cavity formed when joining the cope and the drag defines a plurality of connected walls with a window in each of two of the plurality of connected walls. In addition, the mold is created such that the parting plane is oriented at approximately a 45 degree angle from each of the two defined walls with a window. In some embodiments, the mold is a sand mold. In such embodiments, creating the sand mold includes using a tool is used to impress the shape of the segment into the sand of the cope and the drag. Also, the cope is configured to define the inner portion of the plurality of walls and the drag is configured to define the outer portion.

At 604, molten material is injected into the mold. Exemplary molten material used in embodiments of the present invention includes, but is not limited to, iron, steel, bronze, brass, aluminum, and plastic. At 606, the cope and the drag are separated once the molten material has cooled to release the cast segment. In particular, the cope and the drag are separated in a direction perpendicular to the parting plane. As described above, by orienting the parting plane at a 45 degree angle from the walls with a window, a window can be cast in two walls simultaneously rather than in only one wall.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A method of manufacturing a chassis, the method comprising:

casting a first segment having a plurality of connected walls such that a window is cast in each of two of the plurality of connected walls in the first segment;

casting a second segment having a plurality of connected walls such that a window is cast in each of two of the plurality of connected walls in the second segment; and coupling the first and second segments together to form the chassis having a window in four walls.

2. The method of claim 1, wherein coupling the first and second segments comprises coupling the first and second segments at a continuous edge which extends along the plurality of walls of each of the first and second segments, the continuous edge in each of the first and second segments being oriented at approximately a 45 degree angle from each of the two walls having a window.

3. The method of claim 1, wherein casting the first and second segments comprises one of sand casting the first and second segments, and die casting the first and second segments.

4. The method of claim 1, further comprising machining features in the first and second segments.

5. The method of claim 1, further comprising:

machining a seal groove in a continuous edge which extends along the plurality of walls of the first segment; and inserting a continuous seal in the seal gland such that the chassis is sealed when the first and second segments are coupled together.

6. The method of claim 5, wherein inserting a continuous seal comprises inserting an O-ring.

7. The method of claim 1, wherein casting the first segment comprises casting the first segment using a first mold; and wherein casting the second segment comprises casting the second segment using the first mold.

8. The method of claim 7, wherein casting each of the first and second segments with the first mold comprises:

creating a mold including a cope and a drag such that the mold cavity formed when joining the cope and the drag defines a plurality of connected walls with a window in each of two of the plurality of connected walls;

injecting molten material into the mold cavity; and separating the cope and the drag after the molten material has cooled.

9. The method of claim 8, wherein creating a mold includes creating a mold with a parting plane oriented at approximately a 45 degree angle from each of the two defined walls with a window.

10. The method of claim 8, wherein creating a mold including a cope and a drag comprises configuring the cope to define the inner surfaces of each window and the drag to define the outer surfaces of each window.

11. A method of casting a segment of a chassis having a plurality of walls with a window in each of two of the plurality of walls, the method comprising:

creating a mold including a cope and a drag such that the mold cavity formed when joining the cope and the drag defines a plurality of connected walls with a window in each of two of the plurality of connected walls;

injecting molten material into the mold cavity; and separating the cope and the drag after the molten material has cooled to release the casted segment.

12. The method of claim 11, wherein creating a mold includes creating a mold with a parting plane oriented at approximately a 45 degree angle from each of the two defined walls with a window.

13. The method of claim 11, wherein injecting molten material into the mold cavity comprises injecting one of iron, steel, bronze, brass, aluminum, and plastic.

14. The method of claim 11, wherein creating a mold including a cope and a drag comprises configuring the cope to define the inner surfaces of each window and the drag to define the outer surfaces of each window.

* * * * *